US005137281A

United States Patent [19]

Lehmann et al.

[11] Patent Number: 5,137,281

[45] Date of Patent: Aug. 11, 1992

[54] GAME PLAYING PIECE

[76] Inventors: Roger W. Lehmann, 18 Flintlock Ct., Bernardsville, N.J. 07924; Michael I. Satten, 26 Cow La., Kings Point, N.Y. 11024

[21] Appl. No.: 697,804

[22] Filed: May 9, 1991

[51] Int. Cl.[5] ..... A63F 3/00; A63F 15/06

[52] U.S. Cl. ..... 273/291; 273/272; 446/325; 446/396

[58] Field of Search ..... 273/291, 288, 260, 272, 273/146, 147; 446/325, 396, 264, 256

[56] References Cited

U.S. PATENT DOCUMENTS

| | | | |
|---|---|---|---|
| 361,721 | 4/1887 | Schmitthenner | 273/291 |
| 1,520,011 | 12/1924 | Clark | 273/146 |
| 2,632,977 | 3/1953 | Valasek | 446/325 |
| 4,030,210 | 6/1977 | Stebbins et al. | 273/146 |

FOREIGN PATENT DOCUMENTS 509704 4/1956 Fed. Rep. of Germany .

*Primary Examiner*—Benjamin Layno

*Attorney, Agent, or Firm*—Samuel J. Stoll; Robert S. Stoll

[57] ABSTRACT

A word game playing piece having at least one gravity-stable playing position, at least one gravity-unstable playing position, and a holder that supports the playing piece in its gravity-unstable position. The playing piece is provided with word game indicia, concealed when the playing piece is in its gravity-stable playing position, and revealed when the playing piece is supported in its gravity-unstable playing position by the holder. The player piece is automatically self-righting from gravity-unstable to gravity-stable position to minimize the exposure of its indicia to view.

8 Claims, 2 Drawing Sheets

Fig. 1.
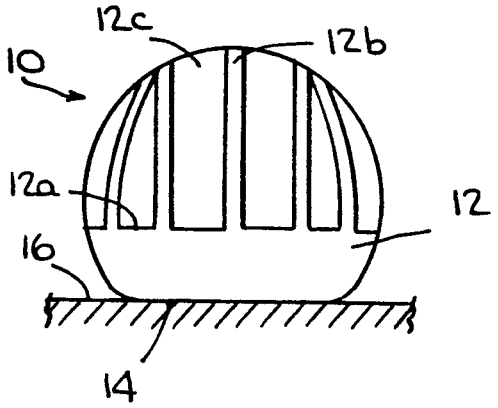
Fig. 3.
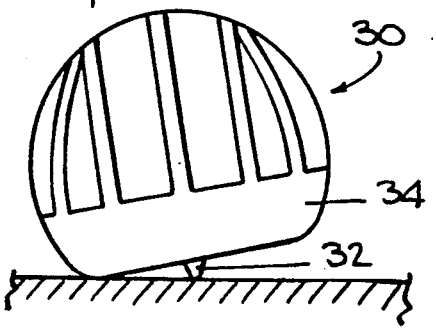
Fig. 2B.
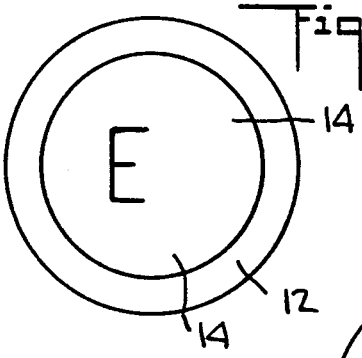
Fig. 2A.
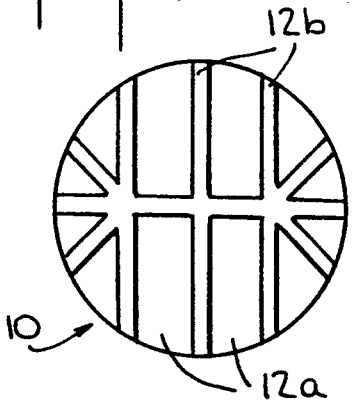
Fig. 4.
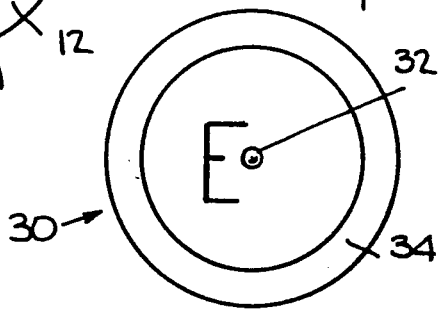
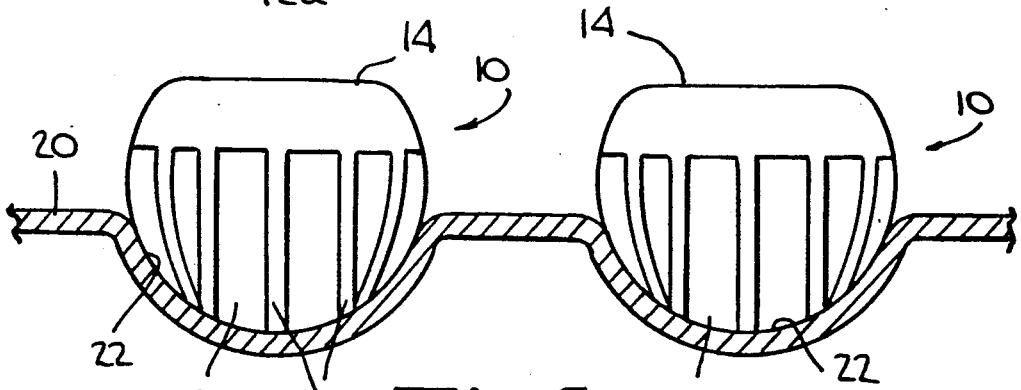
Fig. 5.

GAME PLAYING PIECE

BACKGROUND OF THE INVENTION

The present invention relates to word games such as "Scrabble".

PRIOR ART

The closest prior art known to applicants consists of the following U.S. Pat. Nos.:

| | |
|---|---|
| 361,721 | Schmitthenner |
| 1,630,137 | Ruwwe |
| 2,332,507 | Dailey |
| 2,942,379 | Oman et al. |
| 3,323,798 | Miller |
| 3,805,444 | Adickes |

The closest of these patents is the Schmitthenner patent that discloses a game (chess) playing piece that has a gravity-stable (upright) playing position. It has no other playing position, and certainly no gravity-unstable playing position. Schmitthenner's chesspiece is recognizable in whatever position it may assume. It has no playing position, whether gravity-stable or gravity-unstable, in which its identity is concealed.

The Ruwwe patent discloses a "gravity operated figure toy" that is self-righting. The self-righting action is a playing feature of all of roly-poly toys. But Ruwwe does not show a game playing piece. The function of the self-righting feature of the present invention is to prevent unintended disclosure of the indicia, as when a number of playing pieces are scrambled on an agitator or game board. As they are scrambled, they automatically right themselves to gravity-stable position wherein their indicia are concealed.

SUMMARY OF THE INVENTION

In various word games, the playing pieces are marked with certain indicia such as the letters of the alphabet. In the playing of these games, the playing pieces are scrambled for picking purposes. To make the picking a matter of chance, the playing pieces are scrambled on a vibrator, game board or the like. In such case, it is important to prevent unintentional disclosure of the indicia on the playing pieces. This is accomplished, in the present invention, by rendering the playing pieces self-rightable, that is, by configuring and weighting them to right themselves from gravity-unstable to gravity-stable position.

The indicia are visible on the playing pieces when they are in gravity-unstable position. Conversely, the indicia are concealed when the playing pieces are in gravity-stable position. Thus, the playing pieces are provided with at least two playing positions, one gravity-stable, the other gravity-unstable. When scrambled, they automatically assume their gravity-stable position to conceal their indicia. They may be inverted manually to gravity-unstable position to reveal their indicia. To hold them in gravity-unstable position, they are placed in a holder capable of supporting them in that position.

DESCRIPTION OF THE FIGURES OF THE DRAWING

FIG. 1 is a side view of a game playing piece made in accordance with one embodiment of the invention.

FIG. 2A is a plan view of the bottom side of said playing piece.

FIG. 2B is a plan view of the indicia side of said playing piece.

FIG. 3 is a side view of a modified embodiment of the invention.

FIG. 4 is a plan view of the indicia side thereof.

FIG. 5 is a side view, partly in vertical section, of two playing pieces corresponding to the playing piece of FIGS. 3 and 4, showing them supported in indicia revealing position by a holder.

DESCRIPTION OF ILLUSTRATIVE EMBODIMENTS OF THE INVENTION

Figure 6:
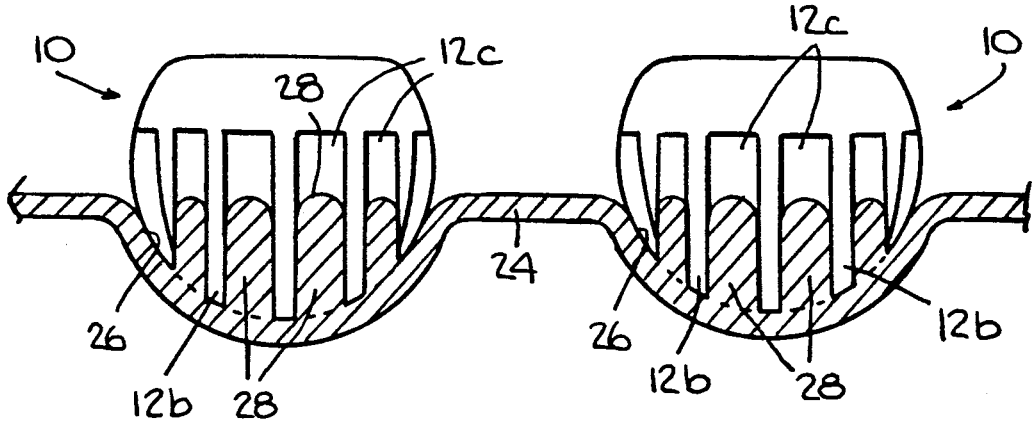
FIG. 6 is a view similar to that of FIG. 5, but showing a modified form of holder.

Referring first to FIGS. 1, 2*a* and 2*b*, it will be observed that one embodiment of the invention comprises a game playing piece 10 having a three-dimensional body 12 defining a segment of a generally spherical configuration. In FIG. 1, three-dimensional body 12 is shown with its segmental plane surface 14 resting on a horizontal supporting surface 16. This is one playing position.

Plan surface 14 is provided with word game indicia such as the letter "E". In the FIG. 1 position of the playing piece, the letter "E" is concealed from view between the three-dimensional body and the supporting surface 16. To expose the letter "E", the three-dimensional body is inverted to its FIG. 2*b* position wherein the segmental plane surface faces upwardly. In this position the three-dimensional is gravity-unstable. To stabilize it in that position it is necessary to support it in a holder such as holder 20 having a number of sockets 22 corresponding to the number of playing pieces to be stabilized. When placed in a socket 22, three-dimensional body 12 is frictionally held in its gravity-unstable position. See FIG. 5.

It will be seen that three-dimensional body 12 has a solid base 12*a* and fins 12*b* extending therefrom. The solid base is radially offset from the geometric center of body 12 to provide the necessary offset weight which, together with plane surface 14, renders the FIG. 1 position of body 12 gravity-stable. It will be understood that body 12 has a longitudinal axis which extends vertically when the body is in its gravity-stable playing position (FIG. 1) and in its gravity-unstable playing position (FIG. 5).

Fins 2*b* perform various functions. Thus, they provide the three-dimensional body 12 with a relatively light-weight structure diametrically opposite the relatively heavy-weight base 12*a*. They also may serve to key the three-dimensional body 12 to a modified holder 24. Sockets 26 in holder 24 are provided with upright fins 28 which are adapted to key into the spaces 12*c* between fins 12*b*. The holder finds 28 lock the three-dimensional body 12 in sockets 26 to stabilize playing piece 10 in its gravity-unstable position shown in FIG. 6.

A modification of playing piece 10 is playing piece 30 shown in FIGS. 3 and 4. The modification consists of a tip 32 which projects from the center of base 34. This tip helps scramble a plurality of playing pieces on a mechanical vibrator, agitator or mixer.

Figure 7:
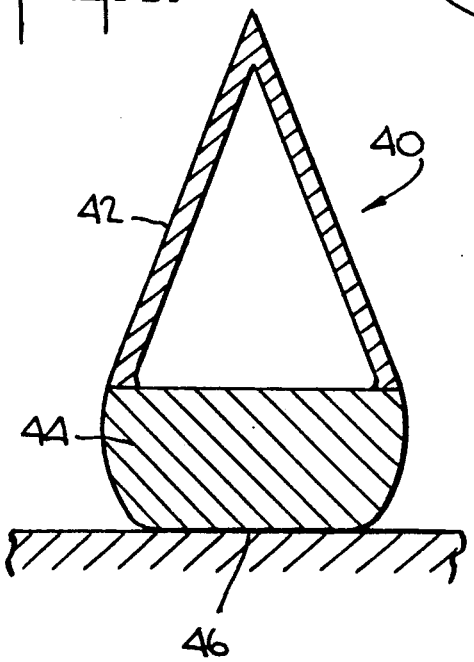
FIG. 7 is a vertical section through a playing piece made in accordance with another modification of the invention.
Figure 9:
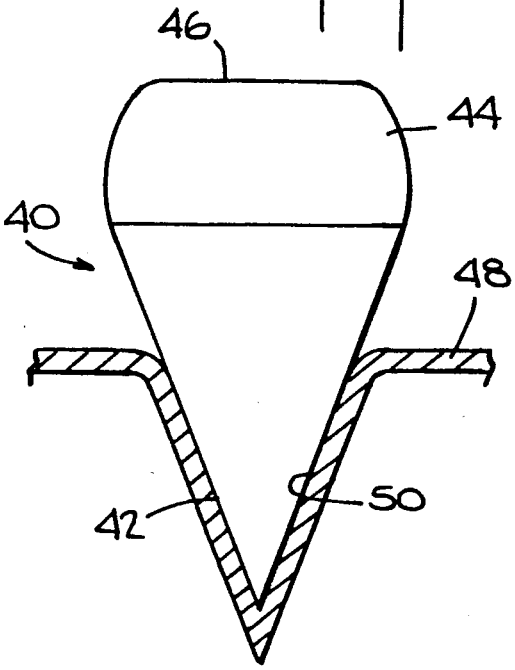
FIG. 9 is a side view of said playing piece showing, in vertical section, a holder supporting it in indicia-revealing position.

Clearly, when playing piece 40 occupies its FIG. 7 playing position, it is gravity-stable. Inverted to its FIG. 9 playing position it becomes gravity unstable. To support it in its unstable FIG. 9 position, it is placed in a holder such as holder 46 which is provided with sockets such as conical socket 48. The conical shape and dimensions of socket 48 complement those of the conical playing piece 40 and provide stability for said playing piece when in gravity-unstable position.

The construction of conical playing piece 40 differs from that of spherical playing piece 10 in that the former comprises a hollow shell and the latter is finned. In both cases, the center of gravity is in, or adjacent, the base, whereby the playing position wherein the base rests on a horizontal surface is a gravity-stable position, the inverted playing position being gravity-unstable.

It is above stated that the three-dimensional body 12 defines a segment of a generally spherical configuration. The key requirement is a configuration-weight combination that renders the playing piece gravity-unstable when in indicia-revealing position. The configuration is not necessarily a sphere or a spherical segment. It may be spheroidal or ellipsoidal or any other shape that prevents gravity-stability except in at least one playing position wherein the playing piece is gravity-stable.

Figure 8:
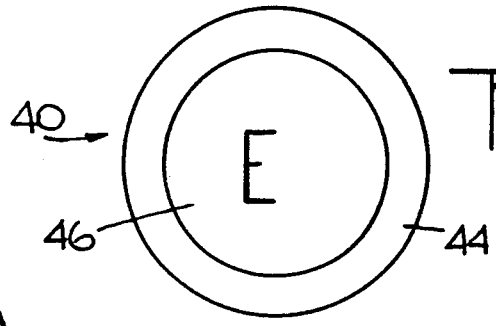
FIG. 8 is a plan view of the indicia side of said playing piece.

A conical shape with a plane surface at its base illustrates another embodiment of this invention wherein the playing piece is gravity-stable in one playing position and gravity-unstable in another playing position. See FIGS. 7–9 wherein game playing piece 40 comprises a conical body 42 and a base 44 having a plane surface 46 on which game indicia may be marked, e.g., the letter "E".

In its FIG. 7 playing position, playing piece 40 is gravity-stable, its marking "E" concealed from view. In its FIG. 9 playing position, playing piece 40 is gravity-unstable position. This holder is provided with conical sockets 50 that complement the conical shape of playing piece 40. When playing piece 40 is in its FIG. 9 position, its marking "E" is exposed to view.

The playing pieces that comprise this invention may be made of any suitable material, e.g., any suitable thermoplastic or thermosetting plastic material. They may also be made of any other conventional material used for word game playing pieces.

The particular playing piece configurations shown in the drawing are illustrative of the many rounded configurations that accord with the principles of this invention as herein described and claimed.

What is claimed is:

1. A game playing piece for use either singly or in multiple, said game playing piece comprising:

a. a three-dimensional body element, b. said body element having at least one gravity-stable playing position, and c. at least one gravity-unstable playing position, d. said body element having a longitudinal axis which extends substantially vertically when the body element is in its gravity-stable playing position, e. said body element being invertible to its gravity-unstable position, its longitudinal axis continuing to extend substantially vertically, f. said body element having a rounded configuration except for at least one substantially segmental plane surface, g. said body element being adapted to assume its gravity-stable playing position when its segmental plane surface rests on a horizontal playing surface, h. a holder being provided for said body element, i. said holder being adapted to support and stabilize said body element in its second, gravity unstable, playing position.

2. A game playing piece in accordance with claim 1, wherein:

a. the body element has a generally spherical configuration except for said segmental plane surface.

3. A game playing piece in accordance with claim 1, wherein:

a. the body element has a generally spheroidal configuration except for said segmental plane surface.

4. A game playing piece in accordance with claim 1, wherein:

a. the body element has a generally ellipsoidal configuration except for said segmental plane surface.

5. A game playing piece in accordance with claim 1, wherein:

a. the body element is relatively heavy at its segmental plane surface and relatively light elsewhere, b. whereby the body element is adapted to assume its gravity-stable playing position when its segmental plane surface rests on a horizontal playing surface.

6. A game playing piece in accordance with claim 1, wherein:

a. the holder is provided with a socket adapted to accommodate said body element, b. said body element being frictionally engageable with said socket.

7. A game playing piece in accordance with claim 1, wherein:

a. the holder is provided with a socket adapted to accommodate said body element, b. said body element being adapted to enter into keyed engagement with said socket.

8. A game playing piece in accordance with claim 1, wherein:

a. the body element is provided with game indicia on its segmental plane surface, b. said game indicia being visible when the body element is in its second playing position.

* * * * *